United States Patent [19]

Swengel, Sr.

[11] Patent Number: 4,681,314

[45] Date of Patent: Jul. 21, 1987

[54] OSCILLATING DEVICE HAVING IMPROVED SUPPORT LEGS

[75] Inventor: Robert C. Swengel, Sr., York, Pa.

[73] Assignee: Donsco Incorporated, Wrightsville, Pa.

[21] Appl. No.: 726,226

[22] Filed: Apr. 22, 1985

Related U.S. Application Data

[63] Continuation-in-part of Ser. No. 629,334, Jul. 10, 1984, Pat. No. 4,575,071.

[51] Int. Cl.[4] ..... A63G 17/00

[52] U.S. Cl. ..... 272/52; 272/53.2

[58] Field of Search ..... 272/52, 52.5, 53.1, 272/53.2, 85, 86, 87, 88, 89, 90, 91, 92; 384/428, 220, 222, 275, 276, 279, 281, 290, 297, 298, 469, 902; 403/24, 25, 354, 241, 264

[56] References Cited

U.S. PATENT DOCUMENTS

| | | | |
|---|---|---|---|
| 121,804 | 12/1871 | Murfey | 384/298 X |
| 162,312 | 4/1875 | Sayre | 403/241 |
| 1,911,866 | 5/1933 | Wylie | 384/276 X |
| 2,230,472 | 2/1941 | Sullivan | 384/222 |
| 2,238,197 | 4/1941 | Watson | 384/222 |
| 2,255,160 | 9/1941 | Gordon | 272/52 X |
| 2,270,392 | 1/1942 | Talmage | 384/222 |
| 2,609,031 | 9/1952 | Puscas | 272/86 |
| 2,668,579 | 2/1954 | Swengel | 272/52 |
| 3,328,100 | 6/1967 | Spokes et al. | 384/298 |
| 3,368,852 | 2/1968 | Herbenar et al. | 384/222 |

FOREIGN PATENT DOCUMENTS

| | | | |
|---|---|---|---|
| 954780 | 6/1949 | France | 403/241 |
| 1333652 | 6/1963 | France | 272/53.2 |
| 580660 | 9/1946 | United Kingdom | 384/276 |

*Primary Examiner*—Robert A. Hafer
*Assistant Examiner*—Danton DeMille
*Attorney, Agent, or Firm*—Adrian J. LaRue

[57] ABSTRACT

An oscillating device comprises a body support on which opposed open bearing-receiving members are located, so that support-bearing members secured to mounting members of legs that are pivotally mounted onto a base are disposed in the bearing-receiving members and springs are mounted on spring-supporting bearing members secured to the mounting members of the legs to maintain the legs in a substantially vertical rest position and to move the body support along an arcuate path when it is moved from the vertical position in an oscillating motion.

11 Claims, 18 Drawing Figures

54
58
32
22
32
52
78
10
18
56
56
14
14
27
26
12
28
28
28
25
26
27
24
25
25

54
58
70
60
62
64
66
52
74
22
55
76
51
51
68
30
32
34
18
16
37
36
30
34
72
78
20
35
35
32
20
38
14
14
38
78

OSCILLATING DEVICE HAVING IMPROVED SUPPORT LEGS

CROSS REFERENCE TO RELATED APPLICATION

This application is a continuation-in-part application of U.S. patent application Ser. No. 629,334, filed July 10, 1984, and now U.S. Pat. No. 4,575,071.

FIELD OF THE INVENTION

This invention relates to an oscillating device and more particularly to an oscillating device having compliant bearings.

BACKGROUND OF THE INVENTION

An oscillating device is disclosed in U.S. Pat. No. 2,668,579 which has C-shaped bearings in which bearing-engaging sections of U-shaped legs are mounted. The U-shaped legs are pivotally mounted at their free ends to a base and the C-shaped bearings have metal housing members secured to a bracket. The bearings also include an elastomer member secured by bonding to the housing member and a rigid metal bearing member secured by bonding to the elastomer. The bearing-engaging sections of the metal legs are disposed in the metal bearing members and are maintained therein by springs extending between rods secured to the legs. These bearings engage the bearing-engaging members along their respective lengths thereby increasing the frictional engagement therebetween when the oscillating device is operated and requiring lubrication to decrease the friction so that the oscillating device will operate smoothly and easily.

Operating tests conducted on the device resulted in failure of the legs adjacent the bearings. This failure is due to the torsional forces being generated during the operation of the device causing the metal to fatigue.

SUMMARY OF THE INVENTION

According to the present invention, an oscillating device comprises a base to which free ends of U-shaped legs are pivotally mounted. Bights of the legs in the form of shafts are disposed as bearing-engaging members in C-shaped bearings secured in a support on which a seat is mounted. The bearings include a rigid housing member, an elastomer member, a stiffly-flexible support member and bearing members of self-lubricating material against which the bearing-engaging members engage, the elastomer member, support member and bearing members being freely floatable in the housing member. Arms extend outwardly from the U-shaped legs adjacent the bearing-engaging members and have rods on which sleeves are freely mounted defining spring-supporting members to which are mounted springs to maintain the bearing-engaging members in engagement with the bearing members thereby maintaining the legs in a substantially vertical rest position and to generate spring forces when the legs are moved in forward and rearward directions thereby creating an oscillating movement.

According to another feature of the present invention, a head member of the oscillating device is secured in position relative to the seat and has no backward or forward movement as well as no sideways movement relative to the seat during oscillating movement of the oscillating device.

According to a further feature of the present invention, a padded cantle is secured on the seat to prevent a person from sliding off the rear of the seat during operation of the oscillating device.

An additional feature of the present invention is a safety shield that is mounted onto the ends of the bracket in which the bearings are mounted to prevent a second person from being injured if the person is in the oscillating path of the device.

A still further feature of the present invention is to apply pads having anti-skid surfaces onto the ends of the horizontal members of the base which also distribute the longitudinal load exerted by the operation of the device.

Still an additional feature of the present invention is the increased length of the spring-supporting members on which the springs are attached. This allows for an additional spring or springs to be added with greater ease, provides wider latitude depending on the weight of the rider and adjusts the period of oscillation to more closely approximate the rate of a normal heartbeat with a consequent salutary effect on the rider.

A further additional feature of the present invention is the use of leg assemblies which include support bearing members and spring-supporting bearing members secured between bearing support members.

DETAILED DESCRIPTION OF THE INVENTION

Figure 1:
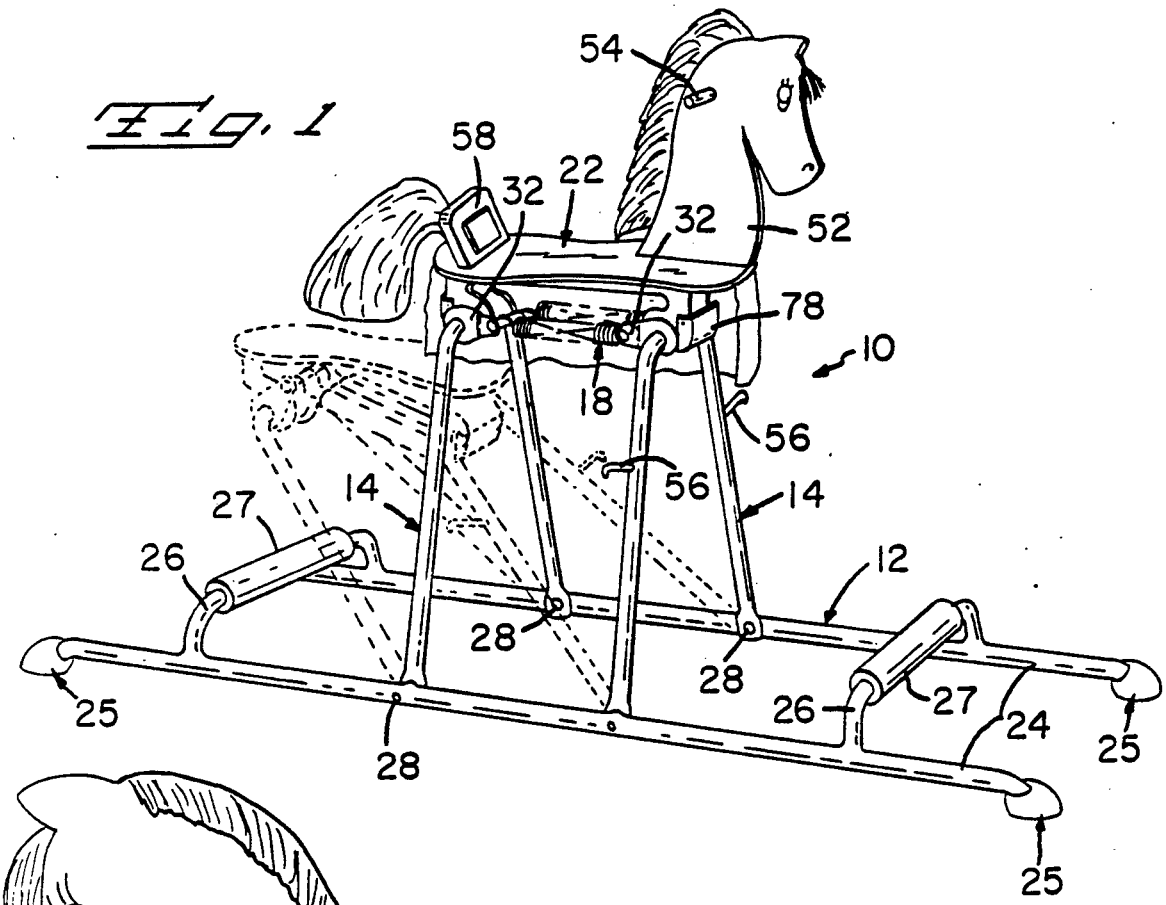
FIG. 1 is a perspective view partly broken away of an oscillating device constructed to form a riding toy, the dotted lines showing one deflected position thereof.
Figure 2:
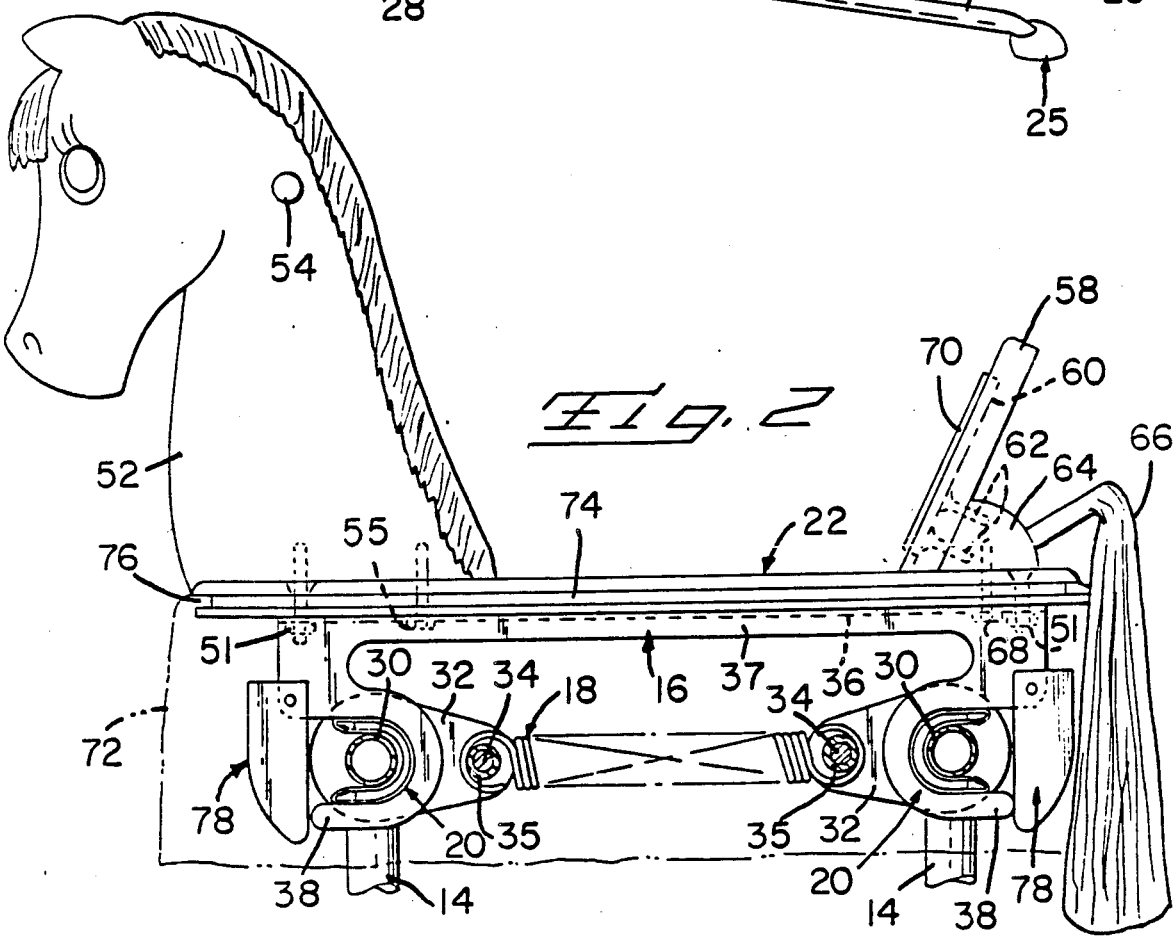
FIG. 2 is a fragmentary cross-sectional and side elevational view of the bracket, seat, head, cantle, bearings, legs and springs.
Figure 3:
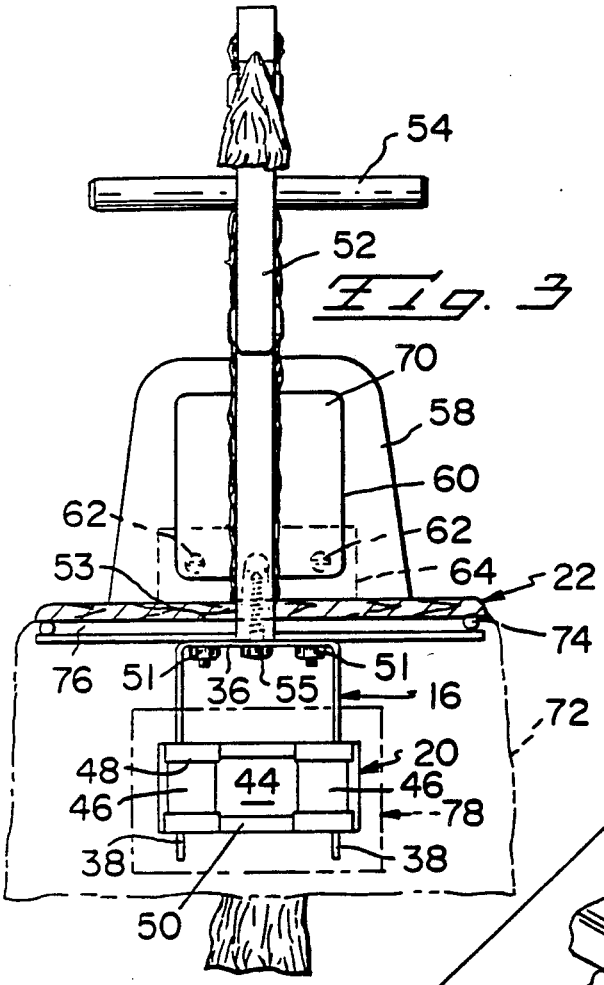
FIG. 3 is a front-elevational view of FIG. 2.
Figure 4:
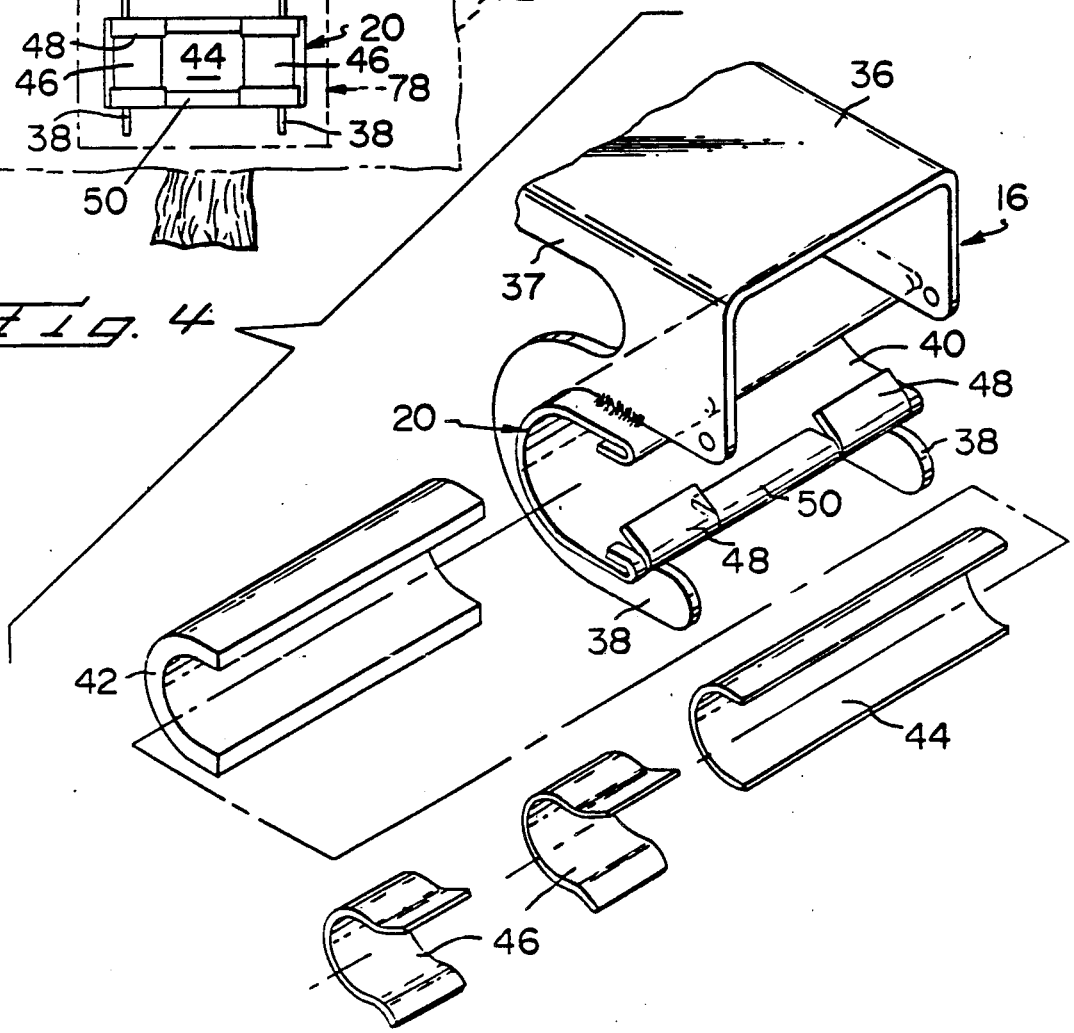
FIG. 4 is an exploded perspective view of the components of a bearing and a fragmentary section of the bracket and a leg member.

FIG. 1 illustrates an oscillating device 10 in the form of an oscillating riding toy that operates in an oscillating manner along an arcuate path when a person rides thereon thereby operating it. FIGS. 2–4 illustrate the bearing as part of bracket 16 for the oscillating device that is of simplified construction, is self-lubricating and operates with substantially reduced friction.

As shown in FIGS. 1 and 2, oscillating device 10 includes a base 12, legs 14, bracket 16, springs 18, bearings 20 and a seat 22.

Base 12 comprises parallel horizontal members 24 that are positioned onto a supporting surface and they have downwardly-bowed ends onto which pads 25 are frictionally mounted for engaging the supporting surface. Upwardly-bowed transverse members 26 maintain members 24 parallel.

Figure 5:
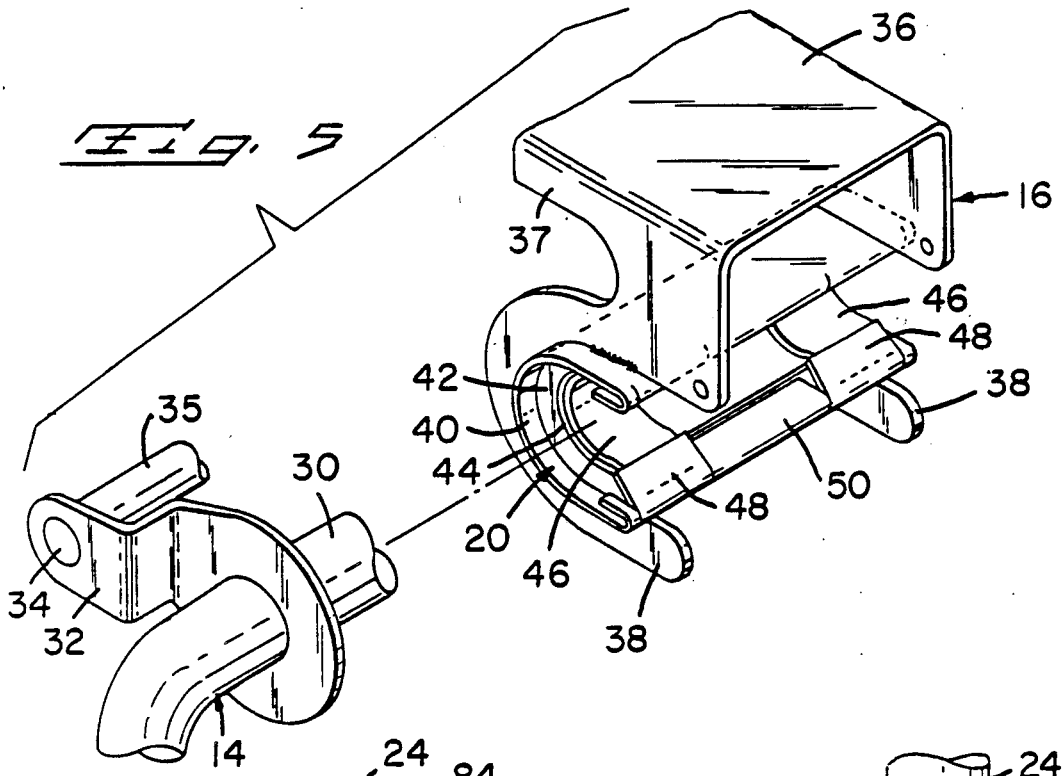
FIG. 5 is similar to FIG. 4 showing the bearing in an assembled condition.
Figure 11:
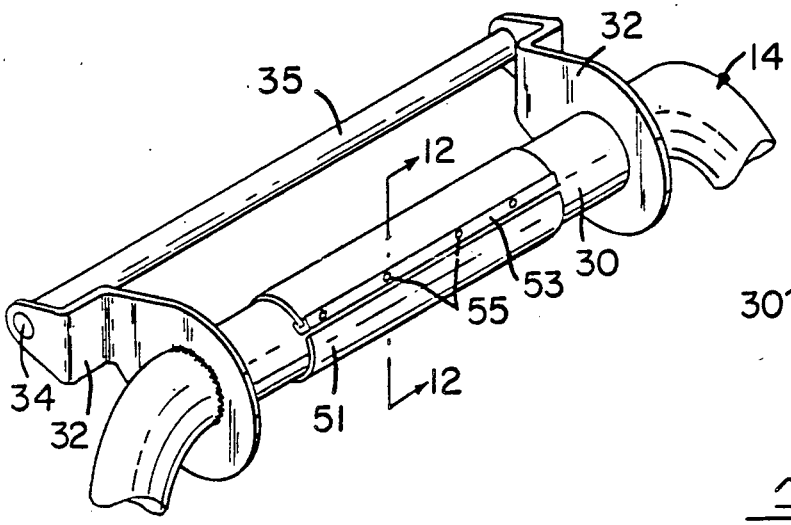
FIG. 11 is a perspective view of a part of a leg member of a further embodiment.
Figure 9:
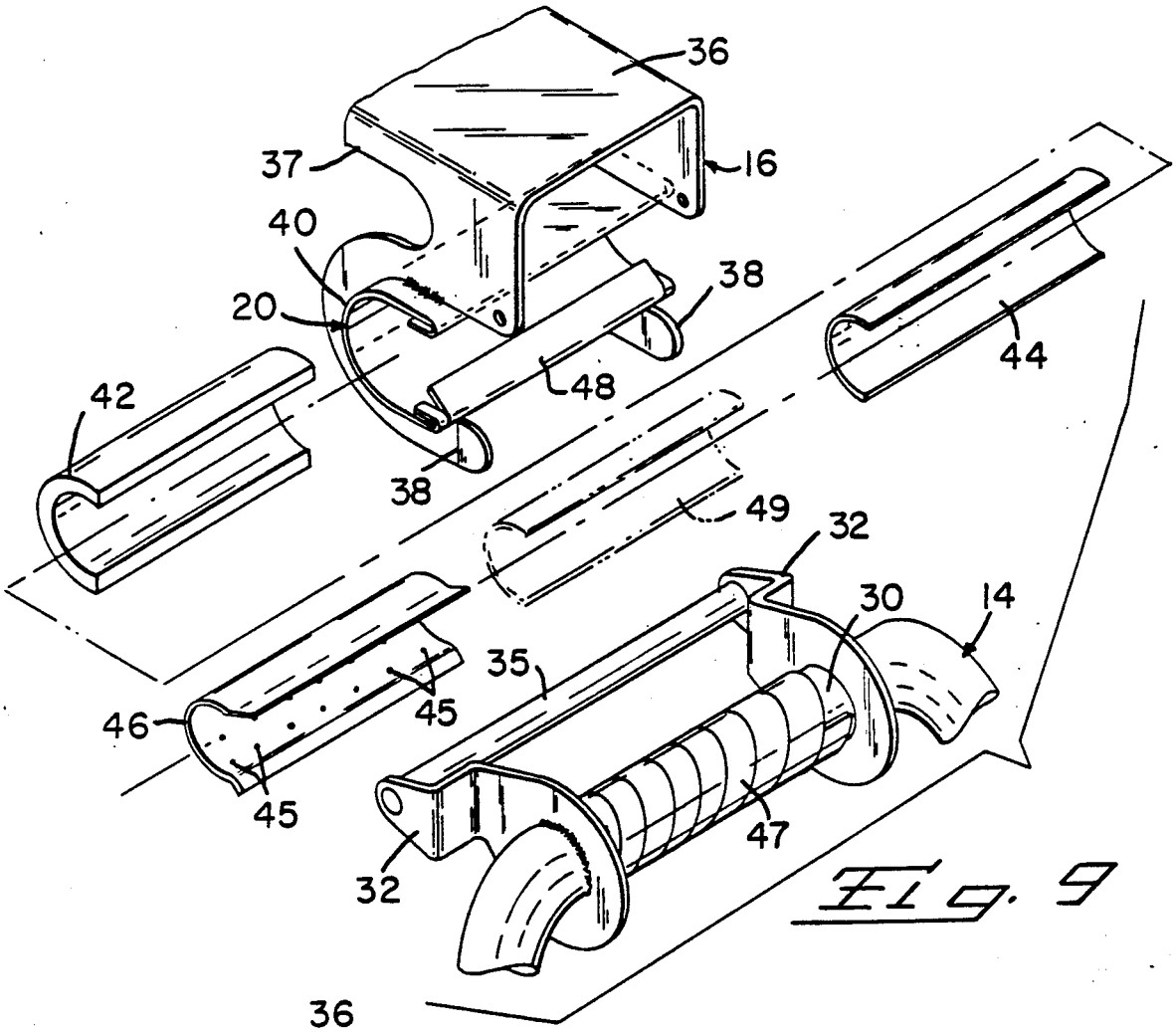
FIG. 9 is a perspective and exploded view of the components of an alternative embodiment of the bearing and a fragmentary section of the bracket and a leg member.

Legs 14 are U-shaped and their free ends are mounted on pivots 28 and members 24. Bights 30 of legs 14 as shown in FIGS. 2, 3 and 5 form bearing-engaging or shaft members for disposition in respective bearings 20 and they must be polished. Arms 32 are secured to legs 14 at respective ends of bights 30, and a rod 34 onto which a sleeve 35 is rotatably mounted extends between each pair of arms 32 on each leg 14. Each pair of arms 32 and associated rod 34 and sleeve 35 is disposed toward the other pair of arms 32 and its associated rod 34 and sleeve 35 when bights 30 are disposed in respective bearings 20. Members 24, 26 and legs 14 are preferably tubular steel. The parts of arms 32 to which rods 34 are secured and between which sleeve 35 extend is offset as best shown in FIGS. 5, 9 and 11 to permit more room for the addition of more springs.

Bracket 16 is formed from a suitable metal and includes as shown in FIGS. 2–5 a base member 36 and a pair of C-shaped members 38 at each end which extend downwardly from base member 36. Side members 37 also extend downwardly from base member 36 and merge into C-shaped members 38.

Bearings 20 are of C-shape configuration and include a C-shaped metal housing member 40, an elastomer member 42, a C-shaped support member 44 and bearing members 46. Housing members 40 are welded within members 38 and their free ends are bent inwardly, but opposing sections 48 of the inwardly-bent free ends are not bent in as far as the other sections as shown in FIGS. 4 and 5.

In assembly, elastomer member 42 is disposed along an inner surface of housing member 40, support member 44 is disposed along an inside surface of elastomer member 42 and bearing members 46 are disposed along an inside surface of support member 44 and the free ends thereof are disposed along opposing sections 48; however, none of the members 40, 42, 44 and 46 are bonded to one another as they are freely floatable in housing member 40.

Elastomer member 42 is any elastomeric material such as rubber or the like. Support member 44 is metal but can be of any suitable flexible material having sufficient rigidity to support a load. Bearing members 46 are of self-lubricating, stiffly-flexible material such as, for example, polytetrafluroethylene, but any stiffly-flexible material having self-lubricating characteristics can be used.

The structure of bearing 20 is simple and constitutes a compliant bearing to readily accommodate shafts therein that do not have to have strict diameter limitations with tight tolerances; thus the shafts do not have to be exactly round within a strict tolerance range.

If desired, bearing members 46 can be a single bearing member, and, if this is the case, then opposing sections 50 at the bent in free ends of housing member 40 are also positioned like sections 48 to accommodate the free ends of the single bearing member. The use of at least two bearing members 46 has, however, been found desirable because of reduced frictional engagement with bearing-engaging members 30.

Bracket 16 is secured to seat 22 via bolts 51 or the like and a horse head 52 or a head of any animal is secured within an open-ended slot 53 in the front end of seat 22 which is provided with hand grips 54 while forward leg 14 is provided with foot rests 56.

The bottom part of head 52 fits snugly within slot 53 in seat 22 and bolts 51, which have their conical heads counter sunk into seat 22 as shown in FIGS. 2 and 3, keep the sides of slot 53 in tight engagement with the sides of the bottom part of head 52 which prevents seat 22 from splitting if it is wood and prevents any sideways movement of head 52. Lag screws 55 also extend through base member 36 of bracket 16 and are screwed into head 52 thereby maintaining the bottom surface of head 52 in secured engagement with base member 36 which prevents any back and forth movement of head 52. This arrangement for securing head 52 within a open-ended slot 53 in seat 52 and in engagement with base member 36 of bracket 16 prevents head 52 from working loose and rendering it stable in directions normal to seat 22 which is a safety feature.

A cantle 58, as shown in FIGS. 1, 2 and 3, has a recess 60 therein and screws 62 are screwed into a mounting member 64 which has a tail member 66 secured in a hole therein. Lag screws 68 extend through holes in base member 36 of bracket 16, through seat 22 and into mounting member 64 thereby securing cantle 58 in position on seat 22 as shown in FIGS. 1–3. A sponge rubber pad 70 or the like is secured in recess 60 of cantle 58. Cantle 58 keeps a person from sliding off seat 22 during operation of the device and pad 70 prevents any back injury to the persons rear back area when engaging the cantle.

A skirt of cloth 72 or other suitable material is secured at its upper hemmed end via a cord 74 being disposed in a groove 76 in the edge of seat 22. Skirt 72 extends to a position below members 38 of bracket 16 to cover bracket 16 and bearings 20 as well as dressing up the device.

Figure 6:
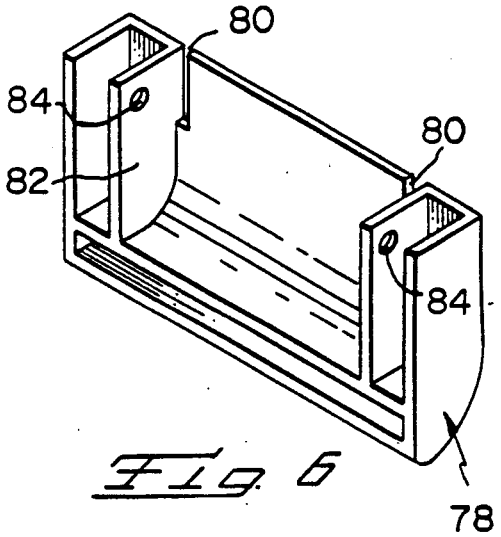
FIG. 6 is a perspective view of a safety shield.

A safety shield 78, as shown in FIG. 6, is mounted on the front and rear ends of bracket 16 to cover the edges of C-shaped members 38 to prevent any injury to a person who might get in the way during the operation of the device. Shield 78 is molded from a suitable plastic material and has slots 80 to accommodate the upper sections of C-shaped members 38. Inner members 82 have holes 84 to receive hollow rivets therethrough to pivotally mount shields 78 to members 38 as shown in FIG. 2 so that shields 78 can be pivoted out of the way to assemble or disassemble the device.

Figure 7:
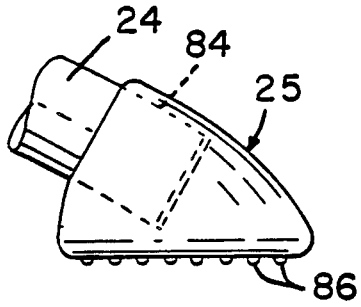
FIG. 7 and 8 are side and front elevational views of a pad on an end of a horizontal member of the base.
Figure 8:
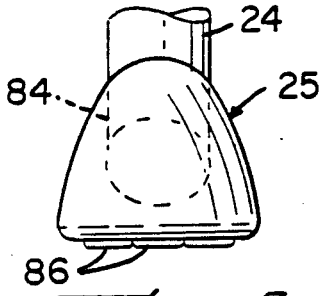

Pads 25 as shown in FIGS. 7 and 8 are molded from a suitable material having anti-skid characteristics and they have a configuration in the form of a horse's hoof. Pads 25 have a sloped bore 84 therein in which the downwardly-bowed ends of members 24 are frictionally fitted. The bottom surfaces of pads 25 are provided with rows of projections 86 along the width and length thereof to provide an anti-skid arrangement, to protect the supporting surface and to distribute the lateral load during operation of the device.

In assembly, legs 14 are mounted on pivots 28 of members 24, front leg 14 having foot rests 56 thereon. Bearing-engaging members 30 of legs 14 are respectively disposed in bearings 20 and springs 18 are mounted onto sleeves 35 of rods 34 which maintain the bearing-engaging members 30 in bearings 20 and the legs in a substantially vertical position of rest. The number of springs 18 varies depending on the weight of the person who will operate the device. Arms 32 prevent any transverse movement of seat 22 and bracket 16.

In operation, a person sits onto seat 22 with hands on hand grips 54 and feet on foot rests 56 and the person's motion causes the device to operate in one direction away from a normal position of rest as shown in broken lines in FIG. 1, and in so doing, causing springs 18 to be extended whereby the springs generate forces to return the device to its normal position of rest, but the motion and weight of the person causes the device to go beyond the rest position to the opposite position whereby springs 18 return the device back toward the first position. This oscillatory action continues so long as the person rides the device along an arcuate path with seat 22 always remaining parallel to the supporting surface. Transverse members 26 restrict the movement of legs 14 and elastomer bumpers 27 can be mounted thereon to prevent metal legs 14 from engaging metal members 26.

Elastomer members 42 of bearings 20 distribute the load thereon and bearing members 46 also help to distribute the load, provide lubrication and reduced friction for long-lasting operation free of applying lubrication.

Both bearing-engaging members 30 can be easily removed from their respective bearings 20, the body removed and the device can then be folded for easy storing or transportation.

The operation of the riding device can be made to operate at a rhythm approximately the heart beat of a human being which will have a soothing and calming effect on the person riding the device.

Figure 10:
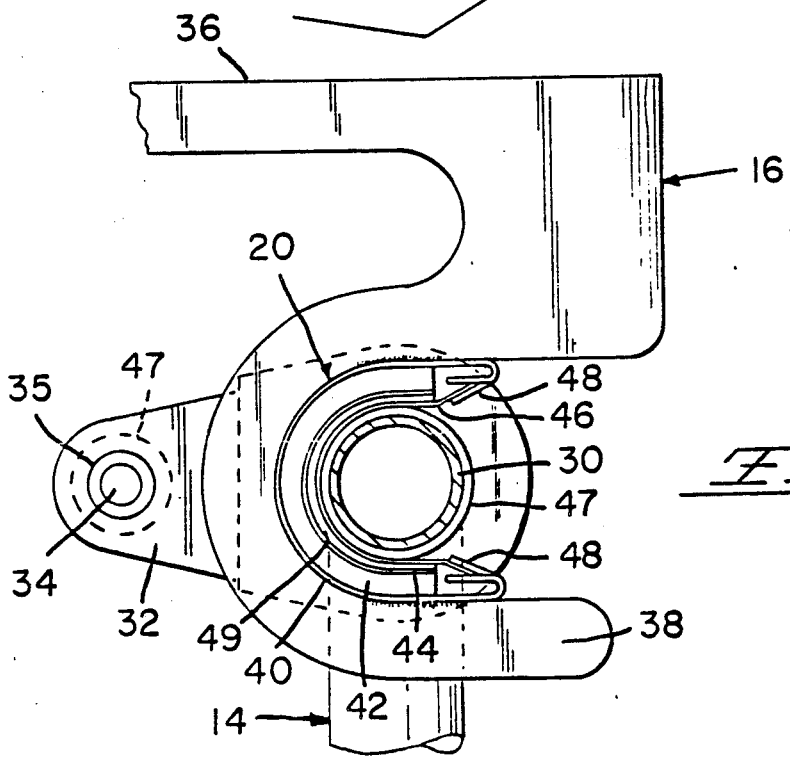
FIG. 10 is a cross-sectional view of the bearing of FIG. 9 in an assembled condition with the shaft in position therein.
Figure 13:
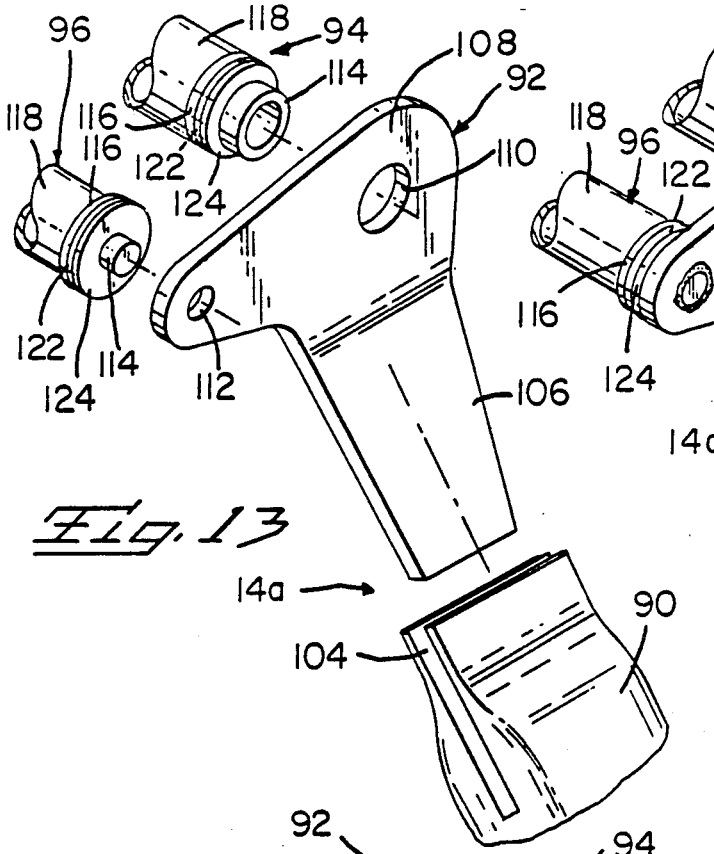
FIG. 13 is an exploded perspective view of the members of the leg in an unassembled condition, the leg and bearing members being fragmentary.

FIGS. 9 and 10 show an alternative embodiment of the bearing which includes elastomer member 42, support member 44 and bearing member 46 freely disposed in housing member 40 except that bearing member 46 is a single member of very thin metal, such as for example brass, having minute holes 45 extending therethrough. The inner bearing surface of bearing member 46 has a polished finish and the free ends are captured in the inturned free ends 48 of housing member 40.

Self-lubricating material 47, like bearing members 46 in the bearing of FIGS. 4 and 5, is in a spiral configuration and it is positioned into bight or shaft 30 of legs 14 without any bonding and the spring characteristics of spiral material 47 maintains it in position on shaft 30. Thus, shafts 30 with spiral material 47 thereon are positioned in bearings 20 and provide the necessary lubrication while operating within bearing members 46 and no polishing of shaft 30 is required.

If the coefficient of friction is desired to be further reduced, a felt pad 49 or the like, as shown in FIGS. 9 and 10, can be disposed between support member 44 and bearing member 46, and a conventional lubricating oil is applied to felt pad 49 thereby supplying oil via holes 45 onto spiral material 47. Oil will have to be periodically supplied to pad 49 as needed. Supporting member 44 acts as a barrier to prevent the oil from getting on elastomer member 42.

Figure 12:
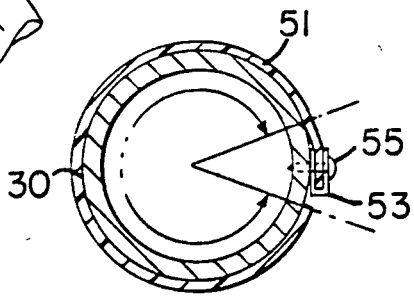
FIG. 12 is a cross-sectional view taken along line 12—12 of FIG. 11.

Instead of spiral material 47, a split tubular member 51 of self-lubricating material is secured onto bight or shaft 30 of legs 14 as shown in FIGS. 11 and 12. One end of split tubular member 51 is positioned in a U-shaped metal clip 53 and conventional spiral drive nails 55 are driven through clip 53, the end of member 51 and anchored in holes in shaft 30 thereby securing member 51 thereon for operation in bearing 20. If desired, metal clip 53 can be H-shaped having an arcuate configuration to that both ends of split tubular members, can be disposed therein and nails 55 driven therethrough into holes in shaft 30.

Thrust plates are an integral part of the pivots 28 against which the legs 14 can exert lateral forces.

FIGS. 13–18 show an alternative leg **14*a* that is stronger than legs 14** to withstand the torqueing action generated onto the legs during the operation of the device and to withstand the loads carried on the oscillating device during the operation thereof in addition to withstanding the forces generated by the springs.

While legs 14 are made of tubular steel to which arms 32 are welded, legs **14*a* are of substantially different construction and are much stronger. Legs 14*a* include tubular steel members 90, L-shaped bearing support members 92, support bearing 94 and spring-mounting bearing 96. Front leg 14*a* also has foot rests 98 secured thereto; otherwise, legs 14*a*** are the same.

Figure 15:
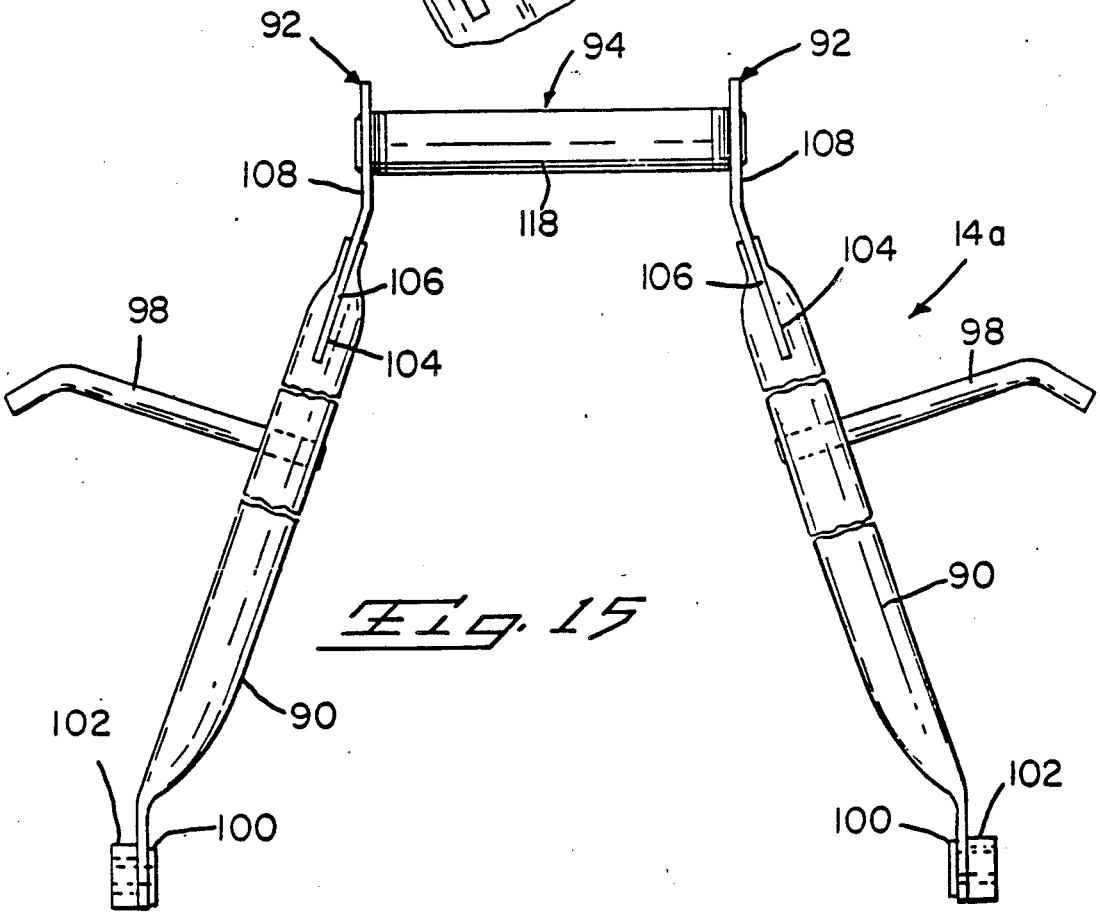
FIG. 15 is a front elevational view of completely assembled front leg.

As shown in FIG. 15, the bottoms of tubular steel members 90 are flattened and radiussed and have a hole extending therethrough. The flattened bottoms of members 90 are parallel as shown in FIG. 15 so that the rest of members 90 extend inwardly toward one another at an angle of about 30°.

A sintered bronze bushing 100 extends through the hole in each flattened bottom of members 90 and is press fitted into steel collars 102; this assembly received a bolt therethrough pivotally mounting leg members **14*a* on members 24 of base 12 with bronze bushings 100** providing lubrication at these pivot points.

Figure 14:
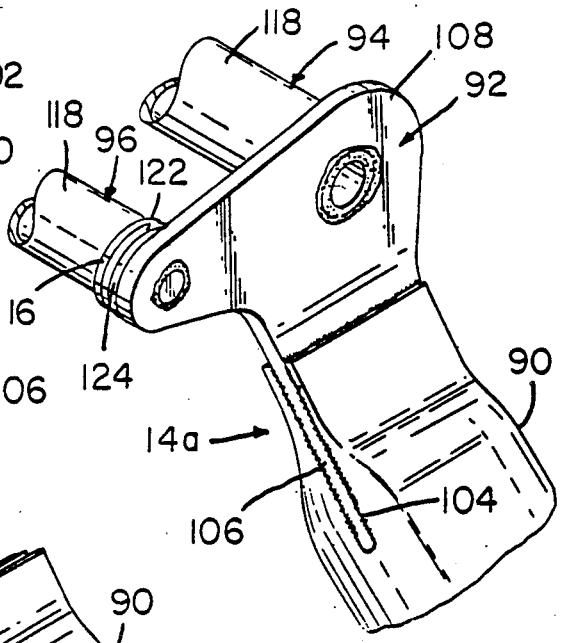
FIG. 14 is a view similar to FIG. 13 in an assembled condition.

The upper ends of members 90 are also flattened and they have a slot 104 therein. Mounting members 92 are of steel with long extensions 106 extending into slots 104 of each member 90. Extensions 106 are welded to respective members 90 along the sides of slots 104 and the top edges of the flattened sides of members 90 as shown in FIG. 14. This arrangement creates an extremely strong joint between members 90 and 92.

Short extensions 108 of mounting members 92 are at an angle with respect to the long extensions 106 so that short extensions 108 are disposed parallel with respect to each other and the flattened bottom sections of members 90 as shown in FIG. 15. Short extensions 108 have holes 110 and 112 therethrough with hole 110 being larger than hole 112. Hole 110 is located in the center of member 92 as well as being coincident with axis of members 90. Hole 112 is disposed in the outer end of short extension 108.

Figure 16:
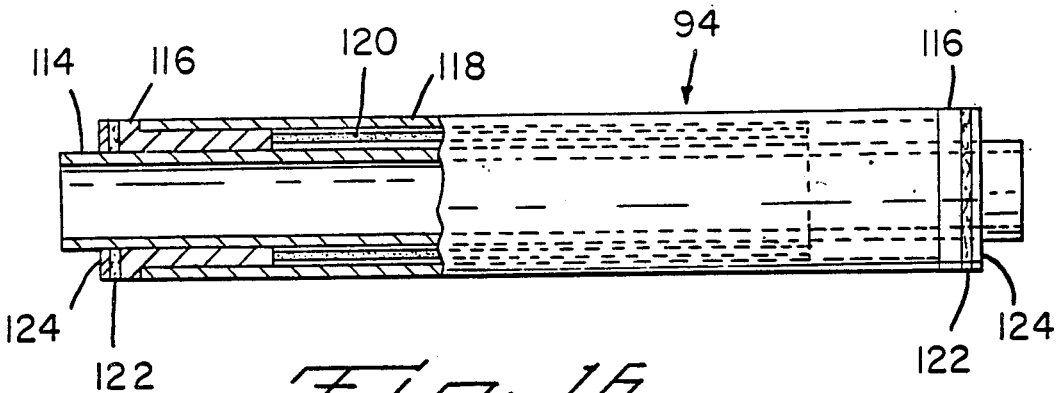
FIGS. 16 and 17 are front elevational views partly in cross section of a supporting bearing and a spring-supporting bearing respectively.
Figure 17:
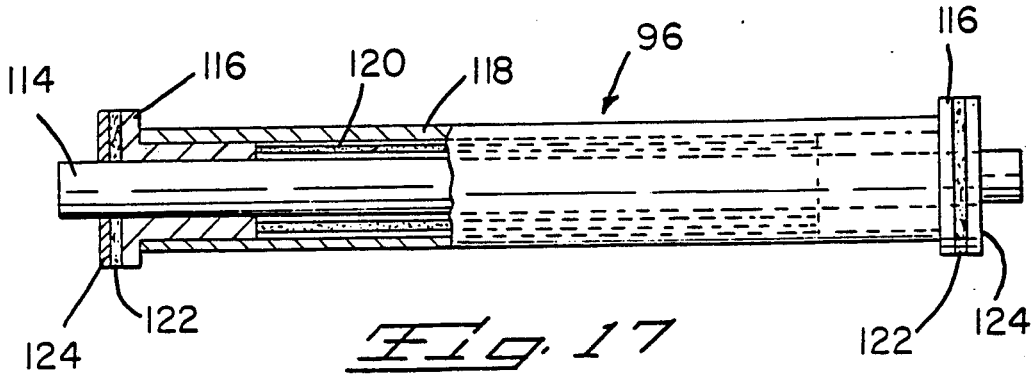

Support bearing 94 and spring-mounting bearing 96 are of the same construction as shown in FIGS. 16 and 17 except that support bearing 94 is larger than bearing 96. Thus, bearing 94 will be described which will also cover bearing 96 with the same reference numerals.

An axle 114 of steel tubing has located thereon an assembly of sintered bronze bushings 116 interference fitted within a steel sleeve 118 so that this assembly can rotate on axle 114. While axle 114 of bearing 94 is steel tubing, axle 114 of bearing 96 is a solid steel shaft because it is smaller in diameter and can better withstand the forces to which it will be subjected.

A felt tubular wick 120 can be disposed between sleeve 118 and axle 114 and between bronze bushings 116 to retain lubricating material and to act as a reservoir for the lubricating material so as to supply the bronze bushings with the lubricating material for smooth operation of the bearings.

Figure 18:
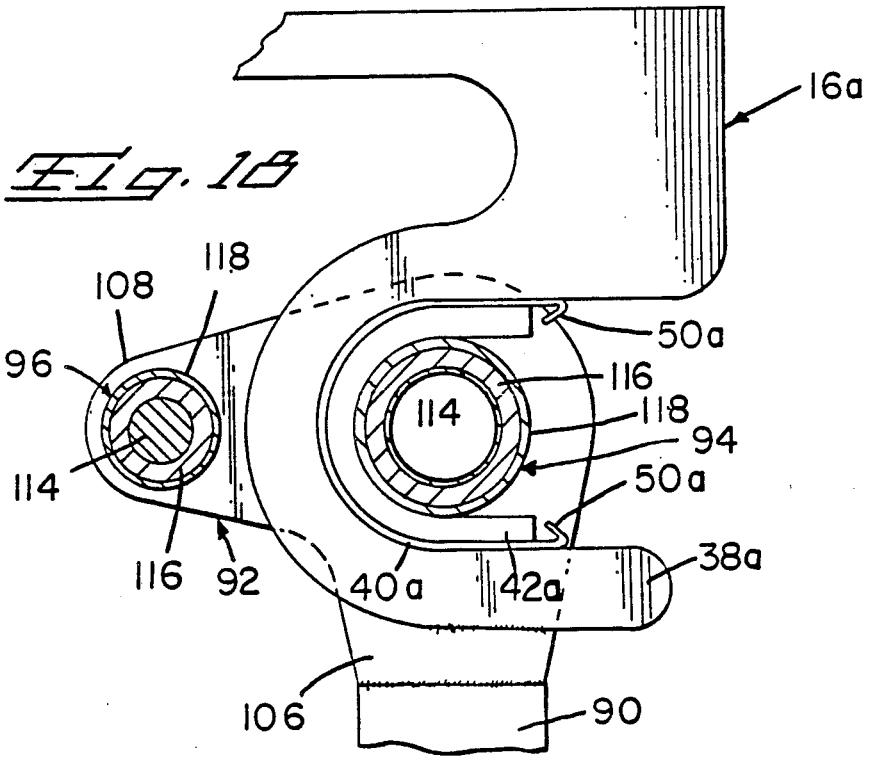
FIG. 18 is cross-sectional view of the support bearing in the C-shaped housing as part of the seat bracket and with an end of a spring member mounted on the spring-supporting bearing.

A wicking washer 122 and metal washer 124 are positioned on each end of axle 114 against bronze bushings 116 and the ends of axles 114 of bearings 94, 96 are disposed in respective holes 110, 112 of mounting members 92 and welded thereto as shown in FIG. 14. Front leg 14*a* as shown in FIG. 15 in its completely assembled condition along with a rear leg without foot rests 98 can now be used in place of legs 14 with bearings 94 being positioned in C-shaped metal housings 40*a* secured in C-shaped members 38*a* of bracket 16*a* and in engagement with C-shaped elastomer member 42*a* which extend between bent-in ends 50*a* of housings 40*a* as shown in FIG. 18. The ends of springs 18 are mounted on respective bearings 96 to maintain bearings 94 in respective housings 40*a* and to store energy for continued oscillatory operation once the oscillatory movement is commenced.

An alternative approach would be to use elastomeric members encircling stationary shafts secured on mount members 92 instead of using springs 18 on spring support bearings 96 for storing the energy of oscillation.

Legs 14*a* provide effective support during the operation of the device as well as smooth operation during the oscillators movement of the device.

As can be discerned, an oscillating device has been disclosed which includes a unique bearing structure, a safety shield mounted on the bracket in which the bearings are located, a head that is strongly secured in position in the seat, a padded cantle to prevent a person sliding off the seat and from injuring a rear part of the back, improved spring attachment means to accommodate lateral thrusts of the legs and anti-skid pads for the base.

I claim:

1. An oscillating device, comprising:

a base;

a pair of front and rear leg assemblies with each pair pivotally mounted on parallel axes at lower ends thereof to said base and extending upwardly therefrom, said leg assemblies each including a pair(s) of leg members and a pair of mounting members, each said leg member(s) being pivotally mounted at the lower end(s) thereof to said base, each said mounting member(s) being an inverted L-shaped bearing support member having the end of the leg portion secured to the upper end of said leg member with the free end portions of the base of the inverted L-shaped bearing support members of the front leg members opposing the free end portions of the support members of the rear leg members (having first sections secured to upper ends of said leg members and second sections extending substantially normal with respect to said first section);

a pair of support-bearing means having one secured between the bases of the front support members and one secured between the bases of the rear support members (said first sections of opposed mounting-members);

a pair of mounting bearing means having one secured between the free end portions of the front support members and one secured between th free end portions of the rear support members (energy-storing means secured between said second sections of opposed mounting members);

body support means having oppositely opening bearing-receiving means in which said support-bearing means are respectively disposed; and energy storing means mounted onto and extending between said opposed mounting bearing (energy-stored support) means to maintain said support-bearing means within said bearing-receiving means, to maintain said body support means centered in a normally vertical position of rest and to move said body support means back toward said centered normally vertical position when said body support means is moved to each side of said vertical position during oscillatory movement thereof.

2. An oscillatory device as claimed in claim 1, wherein said legs are tubular members and said mounting members have the ends of said leg portions (said first sections) disposed in the upper ends of said tubular leg members are welded (together), thereto.

3. An oscillating device as claimed in claim 1, wherein said energy-storing means comprise spring means having their ends mounted on said mounting bearing means.

4. An oscillating device as claimed in claim 1, wherein said support-bearing means and said mounting bearing means each comprise an axle member having its ends secured to respective mounting members, a metal sleeve having bushing means secured to its ends and rotatively mounted on said axle member.

5. An oscillating device as claimed in claim 4, wherein wick means for containing lubricating material is disposed between said axle member and said metal sleeve.

6. An oscillating device as claimed in claim 1, wherein said body support means includes seat means to which is secured bracket means, head means on said seat means, securing means provided by said bracket means and said seat means securing said head means to said seat means and said bracket means.

7. An oscillating device as claimed in claim 6, wherein cantle means is secured on said seat means rearwardly of said head means.

8. An oscillating device as claimed in claim 6, wherein said bracket means includes said bearing-receiving means.

9. An oscillating device as claimed in claim 8, wherein said bearing-receiving means include a C-shaped housing member, an elastomer member extruding along an inside surface of said housing member, and means provided by said housing member and said support member securing said elastomer member in said housing member.

10. An oscillating device as claimed in claim 1, wherein the lower ends of said leg members pivotally mounted to said base are substantially parallel while the remainder of said leg members extend inwardly toward one another.

11. An oscillating device as claimed in claim 1, wherein the bases of said mounting members between which said support-bearing means and said mounting bearing means are mounted are substantially parallel.

* * * * *